United States Patent [19]

Kosten et al.

[11] Patent Number: 5,020,187

[45] Date of Patent: Jun. 4, 1991

[54] FILTER ASSEMBLY FOR A VACUUM CLEANER

[75] Inventors: Richard B. Kosten, West Haven; Charles Z. Krasznai, Trumbull, both of Conn.; Gary Van Deursen, Upper Saddle River, N.J.

[73] Assignee: Black & Decker, Inc., Newark, Del.

[21] Appl. No.: 498,135

[22] Filed: Mar. 19, 1990

[51] Int. Cl.[5] ..... A47L 9/12

[52] U.S. Cl. ..... 15/347; 15/344; 15/352; 15/353

[58] Field of Search ..... 15/344, 347, 352, 353, 15/350, 351

[56] References Cited

U.S. PATENT DOCUMENTS

| | | | |
|---|---|---|---|
| 4,745,654 | 5/1988 | Yamamoto et al. | 15/344 |
| 4,894,882 | 1/1990 | Toya | 15/344 |
| 4,899,418 | 2/1990 | Steiner et al. | 15/344 |
| 4,924,548 | 5/1990 | Touya et al. | 15/344 X |
| 4,928,347 | 5/1990 | Krasznai et al. | 15/344 |

*Primary Examiner*—Chris K. Moore
*Attorney, Agent, or Firm*—Barry E. Deutsch

[57] ABSTRACT

A filter assembly for a vacuum cleaner of the type having a motor, a housing enclosing the motor, a fan driven by the motor for producing a vacuum, and a canister removably attached to the front end of the housing and having an intake nozzle for reception of foreign matter, liquid and air drawn into the canister in response to the vacuum developed by the fan. The filter assembly includes an air permeable filter member disposed within a framework. The filter member includes a front wall. A hollow member extends axially from the front wall towards the open end of the canister. The hollow member is readily graspable by a user when the canister is removed. The filter assembly further includes a filter housing disposed within the canister and having a front wall. A member axially extends from the front wall towards the open end of the canister and is accessible by the user when the filter is removed from the filter housing.

3 Claims, 5 Drawing Sheets

FILTER ASSEMBLY FOR A VACUUM CLEANER

BACKGROUND OF THE INVENTION

The present invention relates generally to portable vacuum cleaners and more particularly, to a vacuum cleaner capable of cleaning both air and liquid.

Portable vacuum cleaners which pick up or vacuum solid or liquid material are known in the prior art. These portable vacuum cleaners are frequently referred to as "wet-dry" vacuum cleaners. Typically, such vacuum cleaners include a filter assembly to deflect or resist the passage of dirt through a passage way to the motor.

An example of a conventional wet/dry vacuum cleaner presently known is a product marketed by The Hoover Company under its trademark "DUBL-DUTY". Details of this wet/dry vacuum cleaner are disclosed in U.S. Pat. No. 4,831,685. The filter assembly of the Hoover product includes a liquid air separator further functioning as a filter housing and a filter member disposed within the separator or housing. The filter member includes a flange having an annular groove or recess which mates with an annular rim or tongue extending from the rear of the separator for connecting the separator to the filter member. The filter member flange also includes a gasket which provides a liquid and air tight seal with the interior surface of the canister of the cleaner. The frictional force holding the filter assembly within the canister is relatively strong.

When the canister is removed from its housing so that the user of the vacuum cleaner can clean the filter, the filter member and separator are removed as an integral unit. In fact, a significant number of the users of such vacuum cleaners do not recognize that the filter must be removed from the separator or housing to clean the same. If the filter is not properly cleaned, a significant degradation of the operating performance of the vacuum cleaner will take place.

Another example of a "wet-dry" vacuum cleaner is the "POWER PRO" cleaner sold by Black & Decker (U.S.) Inc. While this vacuum cleaner has proven generally satisfactory in actual performance, it initially suffered from the same problem associated with the "DUBL-DUTY" vacuum cleaner as previously discussed.

Accordingly, it is an object of this invention to enable a user of a handheld vacuum cleaner to readily remove the filter of the filter assembly when the filter requires cleaning.

SUMMARY OF THE INVENTION

The foregoing object and other objects of the present invention are attained in a filter assembly for a handheld vacuum cleaner. The vacuum cleaner includes a motor, a housing enclosing the motor, a fan driven by the motor for producing a vacuum, and a canister removably attached to the front end of the housing and having an intake nozzle for reception of foreign matter, liquid and air drawn into the canister in response to the vacuum developed by the fan, said assembly comprising means for filtering foreign matter from the air entering the canister; means for housing said filtering means within the canister; first grasping means extending from said filtering means towards the first open end of said canister and readily graspable by the user when the canister is removed from the front end of the vacuum cleaner housing to move the filtering means relative to the housing means towards a first open end of the canister; and second grasping means extending from said housing means towards the first open end of said canister and accessible by a user when the filtering means is removed from said housing means.

DESCRIPTION OF THE PREFERRED EMBODIMENT

Figure 1:
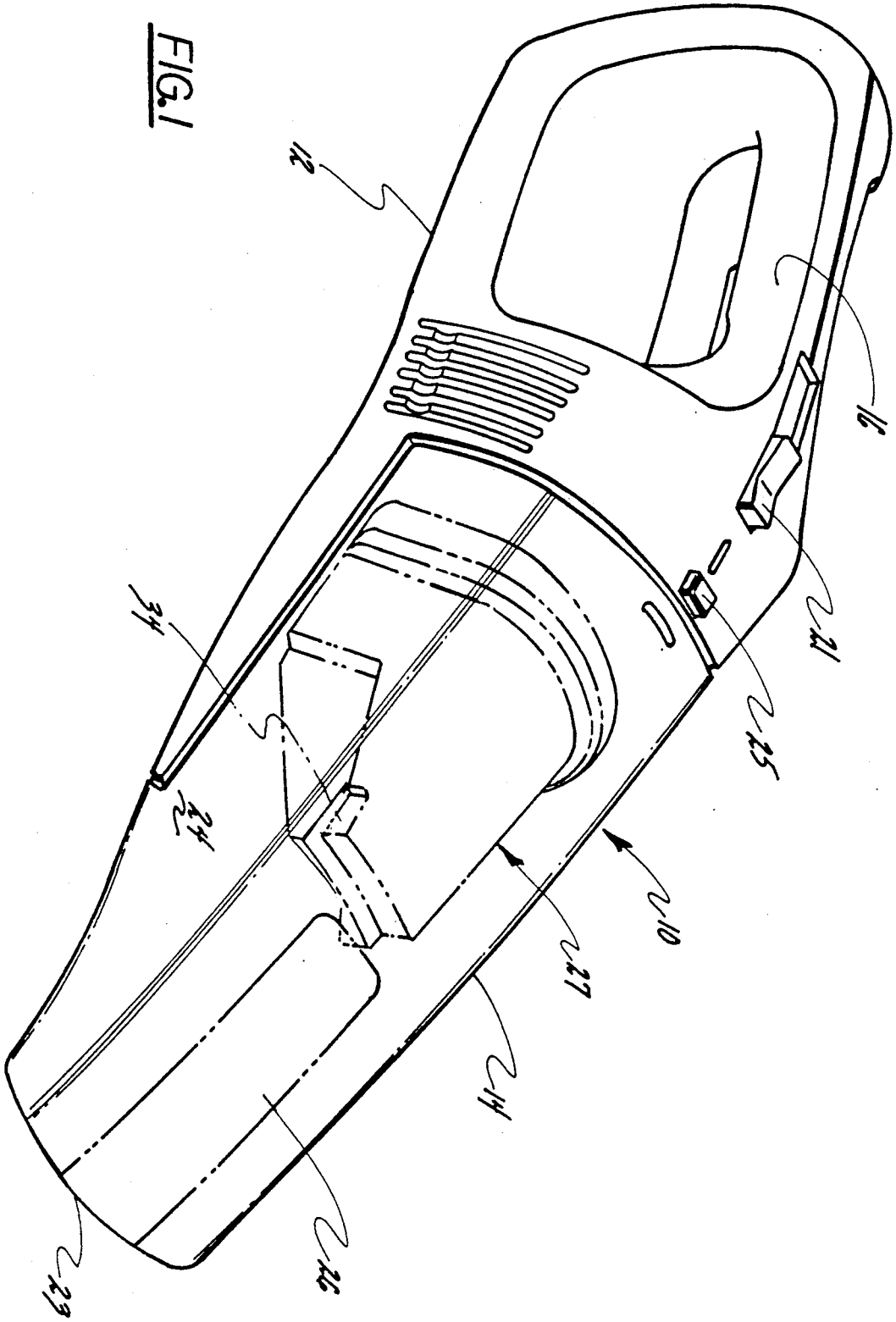
FIG. 1 is a perspective view of a handheld vacuum cleaner in which the filter assembly of the present invention is illustrated in phantom mounted within the canister of the cleaner.

Referring now to the various figures of the drawing, a vacuum cleaner embodying the present invention is shown. In referring to the various figures of the drawing, like numeral shall refer to like parts.

Referring specifically to FIG. 1, a vacuum cleaner 10 is illustrated. Vacuum cleaner 10 comprises a central housing 12 having a canister 14 affixed to a front end thereof and a handle 16 formed near the back end thereof. Handle 16 is configured to be grasped by the hand of a person using the vacuum cleaner for the cleaning of upholstery or rugs, as well as in the dusting of flat surfaces such as the top of a table.

Figure 2:
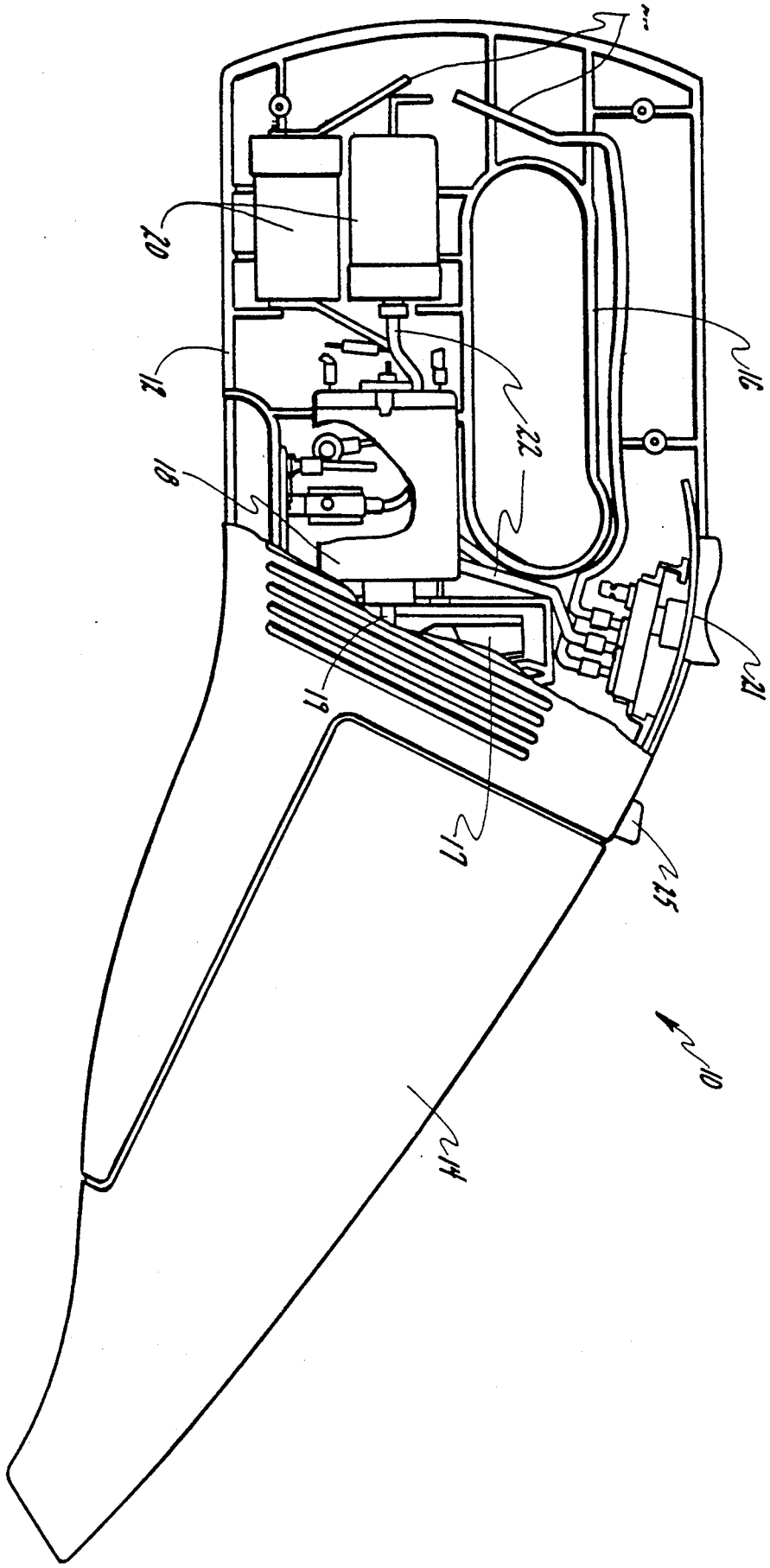
FIG. 2 is an elevational view with a rear portion broken awway of the vacuum cleaner of FIG. 1.

Referring to FIG. 2, housing 12 contains a source of suction or fan 17 which may also be referred to as a blower or impeller, and an electric motor 18 coupled by a shaft 19 to fan 17. Rotation of shaft 19 by motor 18 imparts rotation to fan 17 to create a partial vacuum and the accompanying suction which draws air and foreign matter into canister 14. Motor 18 is powered by a source such as batteries 20. As illustrated in FIGS. 1 and 2, a switch 21 is positioned on the upper side of handle 16 for convenient engagement by means of a thumb of a person utilizing vacuum cleaner 10. Operation of switch 21 provides for the coupling of electric power from batteries 20 to motor 18 for activation of the motor. Electric wiring 22 connects batteries 20 by switch 21 to motor 18.

Referring again to FIG. 1, canister 14 incorporates a nozzle (not shown) at its closed end 23 which opens into a storage chamber 24. Storage chamber 24 is used for the collection of any liquid and dirt which may be drawn by suction or vacuum into cleaner 10. Canister 14 is removably attached to the forward end of housing 12 by means of a latch member 25 or the like.

Canister 14 includes a generally rectangular window portion 26 formed on the top or upper surface thereof. Canister 14 has a generally opaque or cloudy appearance. Window portion 26 is substantially clear or transparent to allow the operator or user to visually see the liquid and/or dirt entering the storage chamber. Window portion 26 is formed with a wall thickness less than the wall thickness of the remaining portion of canister 14. Preferably, window portion 26 has a wall thickness of 1.5 mm while the remaining portion of canister 14 has a wall thickness of 2.5 mm. Also, window portion 26 has a high polish on both sides of its wall. The remaining portion of canister 14 is textured and tinted in color to further provide window portion 26 with its transparent effect.

When vacuum cleaner 10 is in an upright operative position, window portion 26 allows the user to determine the amount of liquid and/or dirt in storage chamber 24 of canister 14. The rearward end of the window portion acts as a fill line such that no further liquid and/or dirt should enter canister 14 to prevent overfilling of the storage chamber.

Figure 3:
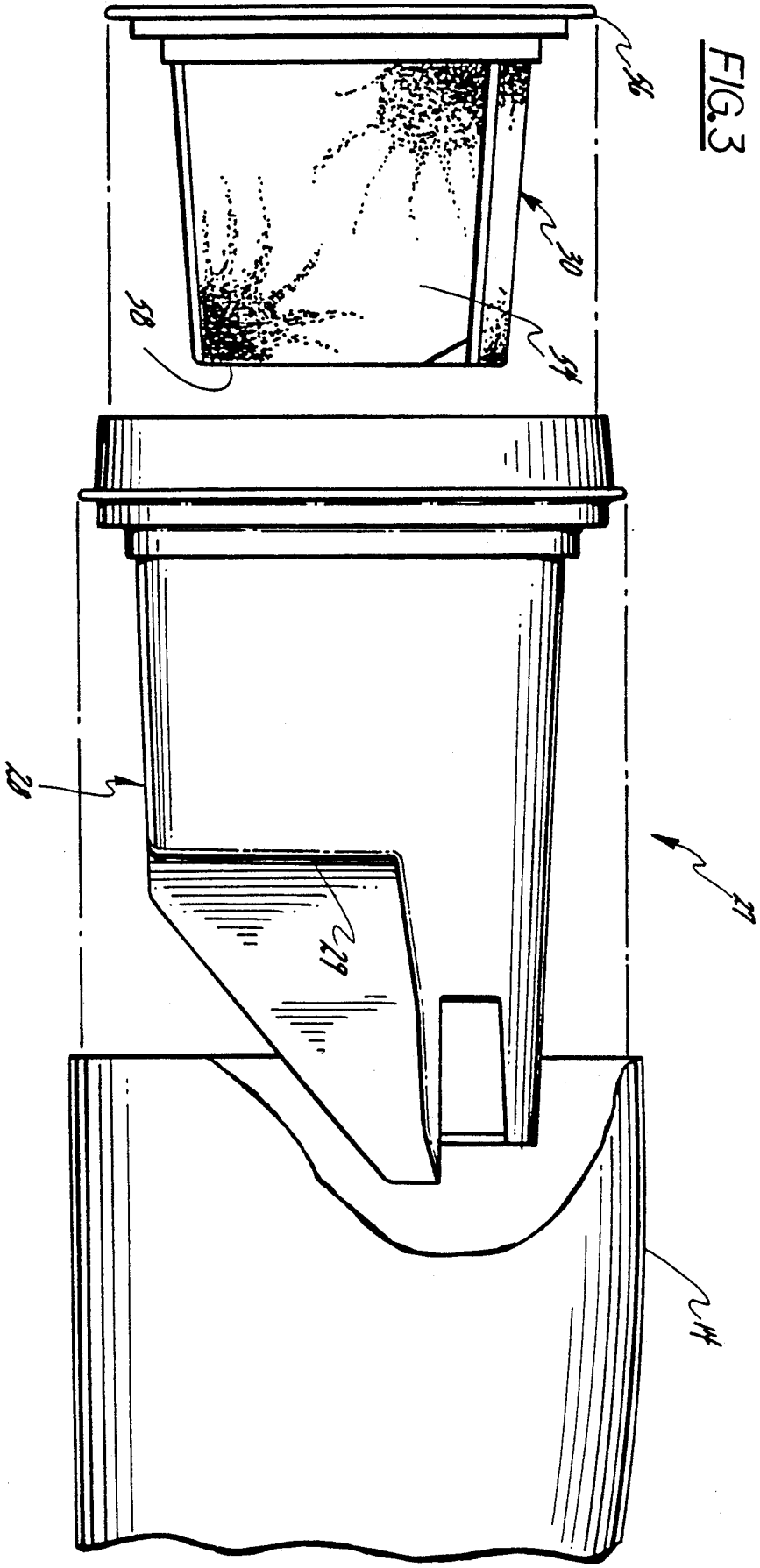
FIG. 3 is an exploded elevational view of the filter assembly and rear portion of the canister of the vacuum cleaner illustrated in FIG. 1.
Figure 4:
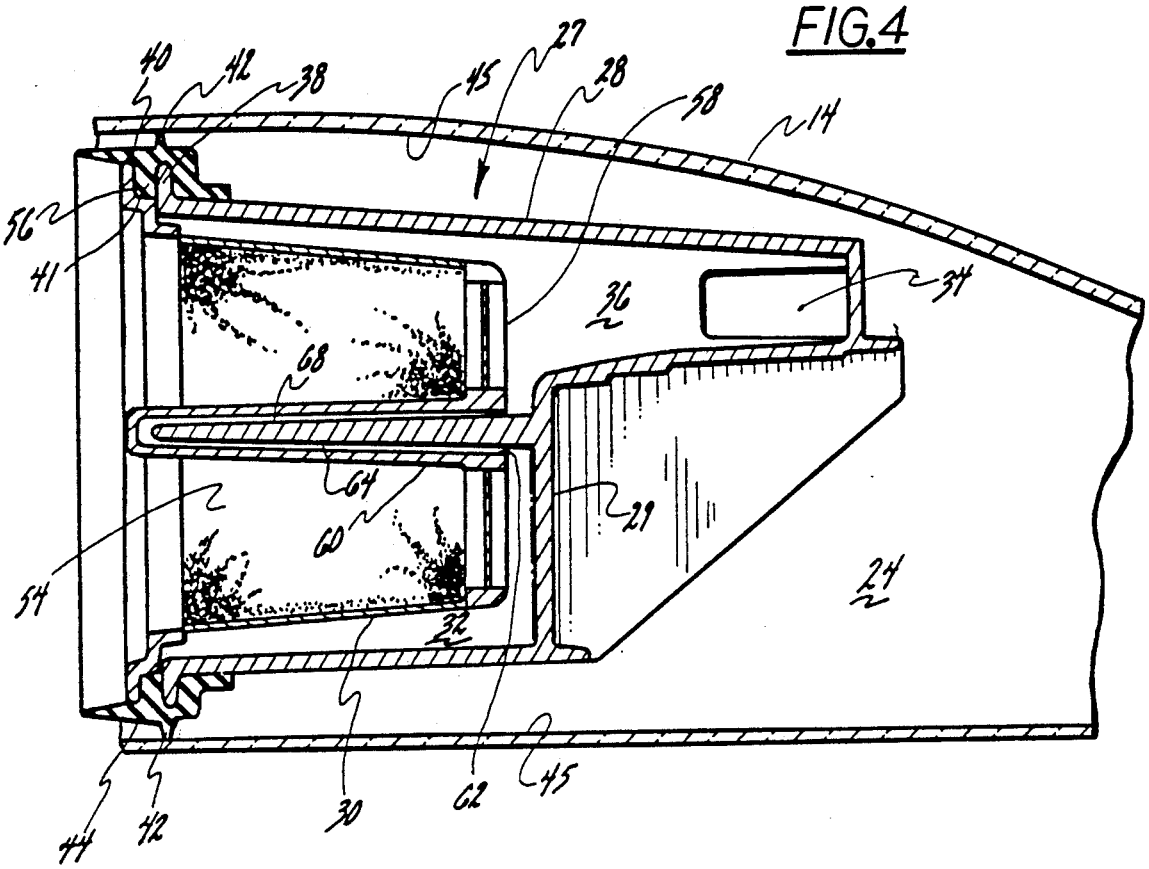
FIG. 4 is a partial elevational view of the filter assembly mounted within the canister of the vacuum cleaner.
Figure 5:
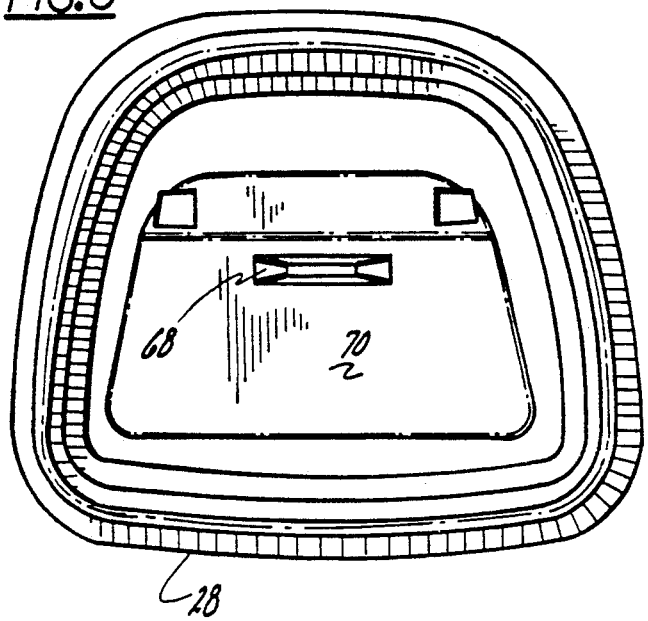
FIG. 5 is an elevational view of the filter of the filter assembly illustrated in FIG. 4 taken from the rear of the assembly.

Within canister 14, a filter assembly 27 according to the present invention is removably disposed. As shown in FIGS. 3 and 4 filter assembly 27 comprises a filter housing, generally indicated at 28 having a deflecting surface 29 to deflect any incoming liquid which flows from the nozzle away from the flow of the airstream, and a filter, generally indicated at 30 disposed within a generally rectangular cavity 32 formed in filter housing 28.

Referring to FIGS. 1, 3 and 4, filter housing 28 includes openings 34 which allow air to flow from storage chamber 24 into the interior of filter housing 28. Openings 34 are located at positions to prevent flow of liquid stored in storage chamber 24 from flowing into them. Openings 34 allow air to flow from the intake nozzle into and through fan 17. A passageway 36 is formed within filter housing 28 and communicates with openings 34 and cavity 32. Filter housing 28 further includes an end flange 38 extending radially outwardly at one end of the opening of cavity 32. A gasket or sealing ring 40 is removably molded about the end of flange 38. Preferably, gasket 40 is made of thermo-elastic material which provides some flexibility and resiliency. Gasket 40 has an interior portion 41 extending radially inwardly to partially cover inflange 38 of housing 28. Gasket 40 also has a sealing lip 42 extending radially outwardly from its outer surface 44. Lip 42 frictionally engages interior surface 45 of canister 14. When sealing flange 42 is seated against interior surface 45 of the canister when the vacuum cleaner is assembled, liquid is prevented from flowing past filter housing 28 to fan 17.

Figure 6:
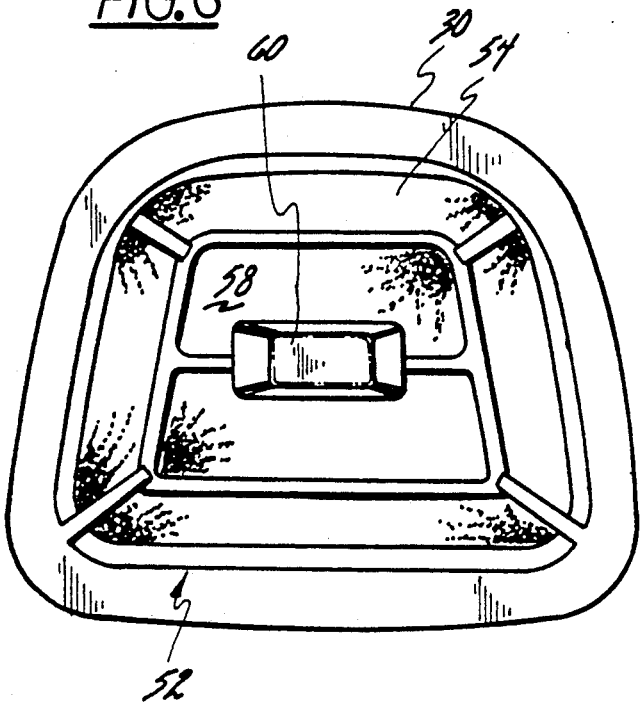
FIG. 6 is an elevational view of the filter housing of the filter assembly illustrated in FIG. 4, with the filter removed and taken from the rear of the filter assembly.

Referring to FIGS. 3, 4 and 6, filter 30 comprises a generally rectangular framework 52 made from a plurality of interconnected ribs. An air permeable filter member 54 is disposed within framework 52 and secured thereto. Filter 30 also includes a sealing flange 56 extending radially outwardly from one end or opening of framework 52. Filter 30 includes a front wall 58. A hollow pull tab member 60 extends axially outwardly from front wall 58 towards the opening of the framework. Pull tab member 60 is adapted to be grasped by the thumb and forefinger of a person and pulled axially to remove the filter from filter housing 28.

As illustrated in FIG. 4, front wall 58 includes a slot 62 axially aligned with pull tab member 60. Since pull tab member 60 is preferably hollow, the hollow interior portion 64 of the pull tab member functions as an extension of slot 62.

A second pull tab member 68 extends axially from inner surface 70 of deflecting surface 29. Second pull tab member 68 extends through slot 62 formed in the front wall of filter 28 and is telescopically received within the hollow portion 64 of the first pull tab member.

When the operator or user of vacuum cleaner 10 recognizes a need or desire for cleaning the filter and canister, the user removes canister 14 from housing 12. The user can then grasp first pull tab member 60 to remove filter 30 from filter housing 28. The user can then clean the filter as required.

Removal of the filter exposes second pull tab member 70. The user can then grasp the second pull tab member to remove filter housing 28 from canister 14. Upon removal of the filter housing from the interior of the canister, the interior of the canister can be completely cleaned as needed.

By providing separate pull tab members on the filter housing and filter respectively, the elements can be separately removed from the canister for more efficient and effective cleaning of the elements. As noted previously, filter assemblies used in handheld vacuum cleaners have heretofore been removable as a unit which has resulted in inefficient or ineffective cleaning of the vacuum cleaner's filter.

While a preferred embodiment of the present invention has been described and illustrated, the invention should not be limited thereto, but may be otherwise embodied within the scope of the following claims.

What is claimed is:

1. A filter housing and filter assembly for a vacuum cleaner, the vacuum cleaner including a motor, a housing enclosing the motor, a fan driven by the motor for producing a vacuum and a canister removably attached to the front end of the housing and having an intake nozzle for reception of foreign matter, liquid and air drawn into the canister in response to the vacuum developed by the fan, said assembly comprising:

means for filtering foreign matter from the air entering the canister;

means for housing said filtering means within the canister;

first grasping means extending from said filtering means towards a first open end of said canister and readily graspable by a user when the canister is removed from the front end of the vacuum cleaner housing to move the filtering means relative to the housing means towards the first open end of the canister; and second grasping means extending from said housing means towards the first open end of said canister and accessible by a user when the filtering means is removed from said housing means.

2. An assembly as set forth in claim 1, wherein:

said first grasping means comprises a generally hollow axially extending member; and said filtering means comprises an integral framework formed by a plurality of ribs and and air permeable filter member disposed within said framework, said filter member having a front wall, said hollow member extending from said front wall towards said open end of the canister.

3. An assembly as set forth in claim 2 wherein:

said front wall of said filter member includes means defining a slot in axial alignment with said hollow member;

said housing means comprises a filter housing disposed within the canister and having a front wall; and said second grasping means comprises a member extending axially from said front wall of said filter housing towards said open end of said canister, said member extending through the slot formed in the front wall of the said filter member and being telescopically received within the hollow member.

* * * * *